US005202729A

United States Patent [19]

Miyamoto et al.

[11] Patent Number: 5,202,729

[45] Date of Patent: Apr. 13, 1993

[54] DEVELOPING APPARATUS HAVING A COATED DEVELOPING ROLLER

[75] Inventors: Toshio Miyamoto, Tokyo; Yasushi Sato, Kawasaki; Akihiko Takeuchi, Yokohama; Hiroshi Sasame, Yokohama; Katsuhiko Nishimura, Yokohama; Hiroto Hasegawa, Kawasaki; Hideyuki Yano; Tatsunori Ishiyama, both of Yokohama; Hideo Nanataki, Tokyo; Harumi Kugoh, Kawasaki, all of Japan

[73] Assignee: Canon Kabushiki Kaisha, Tokyo, Japan

[21] Appl. No.: 783,184

[22] Filed: Oct. 28, 1991

[30] Foreign Application Priority Data

Oct. 26, 1990 [JP] Japan ..... 2-289343
Feb. 20, 1991 [JP] Japan ..... 3-026174

[51] Int. Cl.[5] ..... G03G 15/09

[52] U.S. Cl. ..... 355/251; 118/657; 118/661

[58] Field of Search ..... 355/245, 200, 251, 253; 118/653, 656, 657, 661, 651

[56] References Cited

U.S. PATENT DOCUMENTS

| | | | |
|---|---|---|---|
| 3,863,603 | 2/1975 | Buckley et al. | 355/251 X |
| 4,292,387 | 9/1981 | Kanbe et al. | 430/102 |
| 4,341,179 | 7/1982 | Hosono et al. | 118/658 |
| 4,373,468 | 2/1983 | Suda et al. | 118/658 |
| 4,387,664 | 6/1983 | Hosono et al. | 118/658 |
| 4,458,627 | 7/1984 | Hosono et al. | 118/657 |
| 4,597,661 | 7/1986 | Yamashita | 118/661 X |
| 4,656,965 | 4/1987 | Hosoya et al. | 118/651 X |
| 4,989,044 | 1/1991 | Nishimura et al. | 355/251 |
| 4,990,959 | 2/1991 | Yamamuro et al. | 355/245 |
| 4,990,963 | 2/1991 | Yamamoto et al. | 118/661 X |
| 5,010,370 | 4/1991 | Araya et al. | 355/274 |
| 5,027,745 | 7/1991 | Yamazaki et al. | 118/658 |
| 5,032,852 | 7/1991 | Fujii et al. | 346/157 |
| 5,084,733 | 1/1992 | Katoh et al. | 355/251 |

FOREIGN PATENT DOCUMENTS 55-041889 3/1980 Japan .

*Primary Examiner*—A. T. Grimley
*Assistant Examiner*—Sandra L. Brasé
*Attorney, Agent, or Firm*—Fitzpatrick, Cella, Harper & Scinto

[57] ABSTRACT

A developing apparatus having a container for containing a one component developer, and a rotatable developing roller disposed facing an image bearing member to carry developer from the container to a development zone where it is supplied to an electrostatic latent image carried on an image bearing member. The developing roller includes a metal base member and a resin coating layer thereon in which fine conductive particles are dispersed. The developing roller has a surface including an end region adjacent an end of the roller, and an intermediate region. In the end region, the base member is not roughened and the resin layer is not provided. In the intermediate region, inside the end region, the base member is roughened and is coated with the resin layer. A sealing member is provided for preventing leakage of the developer from the container at the end of the developing roller, the sealing member being faced to the end region of the developing roller.

23 Claims, 7 Drawing Sheets

DEVELOPING APPARATUS HAVING A COATED DEVELOPING ROLLER

FIELD OF THE INVENTION AND RELATED ART

The present invention relates to a developing apparatus for developing an electrostatic latent image formed on an image bearing member.

In an image forming apparatus such as an electrophotographic machine, a developing roller or sleeve is faced to an image bearing member for bearing an electrostatic latent image with a predetermined clearance, the developing roller being supplied with a proper bias voltage to develop the latent image.

In a developing device using a one component developer, the developer (toner) is triboelectrically charged to a polarity suitable for developing the latent image, by friction with the developing roller.

On the toner layer on the developing roller, a ghost which is the hysteresis of a previously printed pattern occurs with the result that the previous image appears on the printed image.

FIG. 1 shows this, wherein there is a portion (a) which is thinly developed because of continuance of non-print (background) and a portion (b) which is thickly developed because of the continuance of the print. If the reflection density difference $\Delta G$ between the portion (a) and the portion (b) is equal to or higher than 0.1D, the non-uniformity of the image is quite conspicuous.

The mechanism of the ghost production has much to do with the layer of fine particles formed on the developing roller. More particularly, the particle size distribution in the bottom layer of the toner on the developing roller is quite different between the toner consumed portion and the toner non-consumed portion, and the toner bottom layer at the non-consumed portion constitutes a fine particle layer mainly comprising particles having particle sizes smaller than the toner average particle size. Since fine particles have a larger surface area per unit volume than large particles, the triboelectric charge per unit weight is larger, and therefore, the fine particles are electrostatically confined by the stronger force to the developing roller by the mirror force. The toner on the fine particle layer is not sufficiently triboelectrically charged by the friction with the developing roller, and therefore, the developing power is deteriorated. Therefore, a ghost image is formed.

On the other hand, in order to improve the fluidity of the developer and to control the triboelectric charge amount, the toner powder contains silica particles produced by gas phase method or the like. In the case of a one component developer comprising negatively chargeable toner and silica particles having a strong negative charging property, it has been found that the ghost image is particularly formed. The reason for this is believed to be that the fine particle toner is more strongly charged by the triboelectricity.

In order to reduce the ghost image, the mirror force between the developing roller and the charged-up fine toner on the peripheral surface of the developing roller varied by one method or another.

U.S. Pat. No. 4,989,044 proposes on the basis of this concept that the electric charge of the fine particle toner is leaked to the developing roller to reduce the mirror force. The developing roller of this patent has a conductive resin coating layer comprising a binder resin material and conductive fine particles (carbon black, graphite are preferable) of non-oxidation or oxidation resisting property dispersed therein.

Using the developing roller, the conductive fine particles provide a good leak site, so that the charge-up of the fine particle toner is constrained, and therefore, the ghost image can be prevented.

Recently, for the purpose of improving the image quality of the electrophotography, the particle size of the toner has been reduced. If a particle size of 6–9 microns and, preferably 6–8 microns (volume average particle size) is used, the resolution, the sharpness and the like are improved. However, if such toner is used, the quantity of fine particles in the particle size distribution becomes relatively large. Such fine particle toner has sufficient triboelectric charge, but the triboelectric charge amount of the toner having the near-average particle size is relatively small. As a result, the printed image has a low density.

A method has been found effective to solve the problem. That is, the surface of the developing roller is roughened (sandblasting with abrasive particles, for example) and then is coated with conductive resin described above so as to provide a roughened coating surface having a center line average roughness Ra of 1.0–3.5 microns. By doing so, a proper roughness of the resin coating layer can be provided.

When such a developing roller is used, the toner conveying power is improved, and in addition, the triboelectric charge of the toner is properly controlled, and therefore, the developed image has a high density with low background fog. Since the base itself has been roughened, the resin coating layer is not easily peeled off even after long term use. Furthermore, the effects of the roughened surface are not reduced easily.

In order to limit the layer thickness of the developer conveyed to the developing zone by the developing roller, a regulating member having a proper length is disposed with a small clearance from the developing roller or in contact with the developing roller.

However, at the longitudinal ends of the developing roller where the regulating member does not act on the developing roller, the developer is leaked from the container to the outside at the longitudinal ends of the developing roller.

In order to avoid this, as shown in U.S. Pat. Nos. 4,341,179, 4,373,468 or the like, a sealing member is contacted to the end surfaces of the developing roller.

In the case of a developing roller having the above-described conductive resin coating layer on a base member having the roughened surface, however, the stronger developer conveying power due to the large surface roughness of the resin layer results in a drawback, in that the developer is introduced into the contact area between the sealing member and the roller.

The developer thus introduced may be disposed from the contact portion and scattered when the roller is rotated. It may be fused on a roller or felt, and to obstruct the smooth rotation of the roller with the result of a deteriorated developed image. It may produce fine masses of developer which are returned to the container, and which produce a non-uniform layer thickness of the developer. Additionally, the sealing member may be damaged relatively quickly.

SUMMARY OF THE INVENTION

Accordingly, it is a principal object of the present invention to provide a developing device having a developing roller coated with a resin material layer in which conductive fine particles are dispersed.

It is another object of the present invention to provide a developing apparatus wherein the developer is prevented from leaking out of the end portions of the developing roller.

It is a further object of the present invention to provide a developing apparatus in which various inconveniences described above can be solved.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
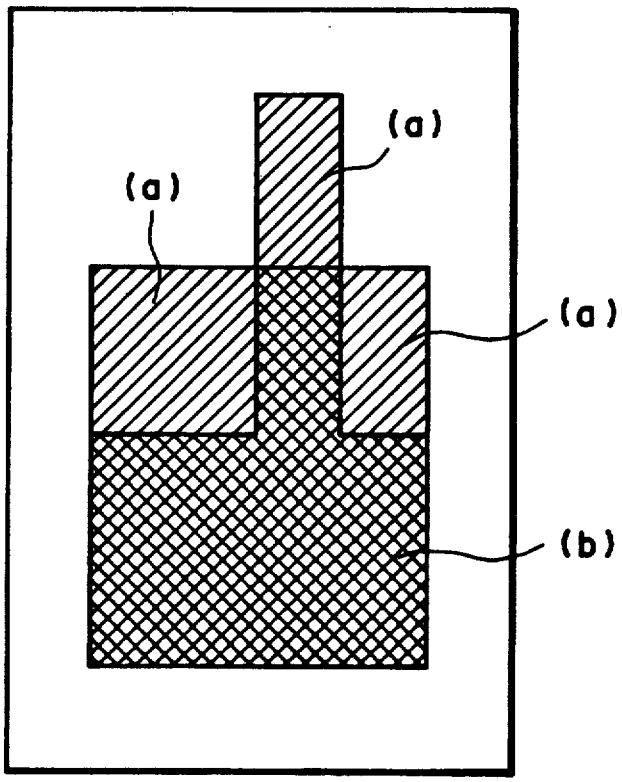
FIG. 1 illustrates a ghost image.
Figure 2:
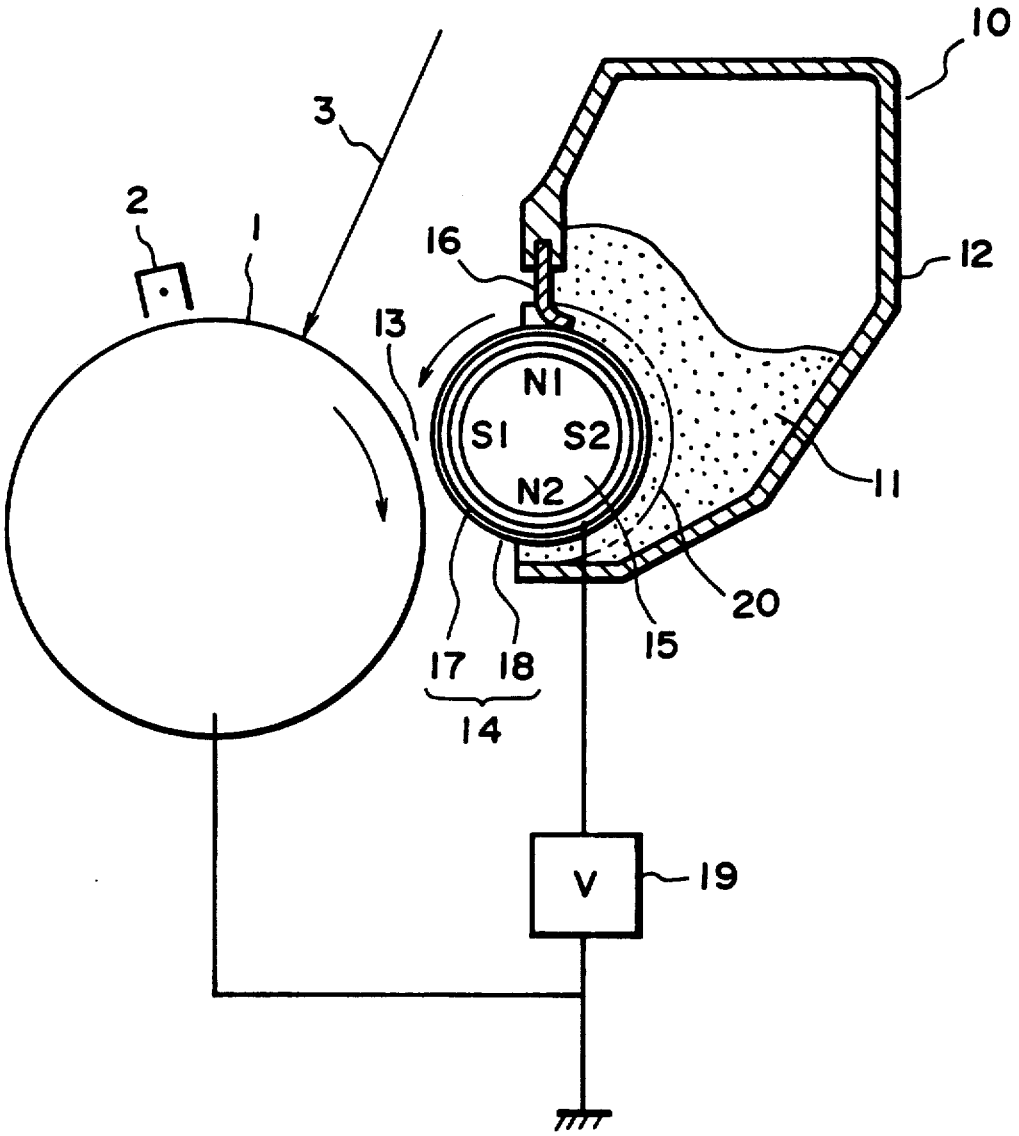
FIG. 2 is a sectional view of a developing apparatus according to an embodiment of the present invention.

Referring to FIG. 2, a developing apparatus using an insulative one component magnetic developer is illustrated. A latent image bearing member 1 is in the form of an electrophotographic photosensitive drum rotatable in the direction indicated by an arrow. It is uniformly charged to a negative polarity by a primary charger 2, and is exposed to a laser beam 3 modulated in accordance with the image to be recorded, so that a negative latent image is formed. The latent image is reverse-developed by a developing apparatus 10. More particularly, the portion having a smaller amount of electric charge because of exposure to the beam, receives the one component magnetic developer having the triboelectric charge with a polarity the same as the latent image, mainly by friction with the sleeve 14.

A one component developer means a developer not containing carrier particles used in a two component developer. In this Specification, the one component developer may be called simply "toner".

The developing apparatus 10 includes a developer container 12 for containing the one component magnetic developer (magnetic toner) 11 and a non-magnetic sleeve 14. A part of the peripheral surface of the developing sleeve 14 is faced into the container 12. When it is rotated, the developer 11 in the developer container 12 is supplied to the developing zone 13 where the developer is supplied to the latent image. In the sleeve 14, a magnet 15 is fixedly mounted for magnetically attracting the developer onto sleeve 14. The layer thickness of the developer conveyed to the developing zone 13, as disclosed in U.S. Pat. No. 4,458,627, is limited by the elastic blade (rubber blade, metal in plate, spring or the like) press-contacted to the sleeve 14 by its elasticity, so that the thickness of the developer layer is reduced to less than the minimum clearance between the drum 1 and the sleeve 14 in the developing zone 13. Therefore, the developer jumps from the layer on sleeve 14 to the drum 1. The developer is electrically charged mainly by friction with the sleeve, and is most actively charged when it passes through the nip between the blade 16 and the sleeve 14.

Similarly to U.S. Pat. No. 4,292,387, the latent image is developed by the alternating electric field between the sleeve 14 and the image bearing member 1. The sleeve 14 is supplied with an oscillating bias voltage which is in the form of a rectangular, sine or the like wave AC voltage biased by a DC voltage. In one phase of the alternating electric field, the toner receives a force in the direction from the sleeve 14 to the photosensitive member 1; and in another phase, the toner receives force in the direction from the photosensitive member 1 to the sleeve 14. By these forces, the toner particles reciprocate, and the developing operation ends with an increase of the distance between the drum 1 and the sleeve 14 because of the curvatures thereof. By doing so, the developed image has a high density of toner and a low background fog. Usually, the AC component of the oscillating bias voltage has a frequency of 1000–2000 Hz and a peak-to-peak voltage of 1100–1800 V (Vpp). When a DC voltage is to be superposed, the DC voltage component is between the light area potential and a dark area potential of the latent image. The oscillating bias voltage is a voltage having maximum voltages and minimum voltages which appear periodically and alternately. It may oscillate across 0 volts or oscillate only in a positive or negative region.

The toner particles not used for the development of the latent image in the developing zone 13, return on the sleeve 14 into the container 12.

In order to provide fine images, it is preferable to use toner particles having a volume average particle size of 6–9 microns, further preferably 6–8 microns. The present invention is suitably used with such developer, but is not limited to use with such developer. In order to control the triboelectric charge and in order to improve the fluidity, negatively chargeable silica fine particles produced by gas phase method or the like, are added to the developer powder. The present invention is usable with an apparatus using a positively chargeable one component developer. Because the resin binder or the like constituting the toner particles is easily triboelectrically charged to the negative polarity, and is more strongly charged to the negative polarity, the present invention is particularly suitable for a developing apparatus in which the developer is triboelectrically charged to a negative polarity The present invention is not limited to the case of reverse development, but is applicable to the case of regular development in which the developer is deposited on the dark area potential region of the latent image.

In addition, the present invention is applicable to an apparatus using a one component non-magnetic developer (hereinafter "non-magnetic toner"). In the case of a one component non-magnetic developer, the magnet 15 is not necessary, and therefore, the developing roller 14 may be in the form of a solid cylinder rather than a hollow cylinder.

The sleeve 14 of FIG. 2 comprises a metal base 17 made of aluminum or stainless steel, the surface of which is roughened by abrasive particles, and a coating in the form of a conductive resin layer 18 having a volume resistivity of $10^2$–$10^{-6}$ ohm.cm applied by a dipping, spray or the like method.

As an example, a drawn aluminum curve (sleeve base) 17 was treated by an ordinary air-sand-blasting machine under the conditions of a pressure of 2 kg/cm$^2$ and working revolutional speed of 20 rpm, using alundum abrasive (A #100) which includes irregular abrasive particles (irregular shape particles having sharp edges). The center line average surface roughness Ra of the surface which was thus produced was approximately 2.0 microns.

The base 17 was coated by air spray with the following paint having the following ingredients:

| <Coating 1> | |
|---|---|
| Resin (binder): phenol resin (solid) | 30 wt. parts |
| Carbon black (fine conductive particles): CONDUCTEX 975UB (trade name, available from Columbian Carbon) | 25 wt. parts |
| Diluent: isopropylalcohol butanol | 200 wt. parts |

Since the binder resin is a heat-curing resin, it was cured in a drying furnace at approximately 150° C. for 30 minutes after the spray coating. The volume resistivity of the resin layer 18 was $7.0\times10^{-1}$ ohm.cm with a thickness of approximately 7 microns. The center line average surface roughness Ra of the resin layer 18 in the roughened region of the surface of the base 17 was approximately 1.8 microns.

Figure 3:
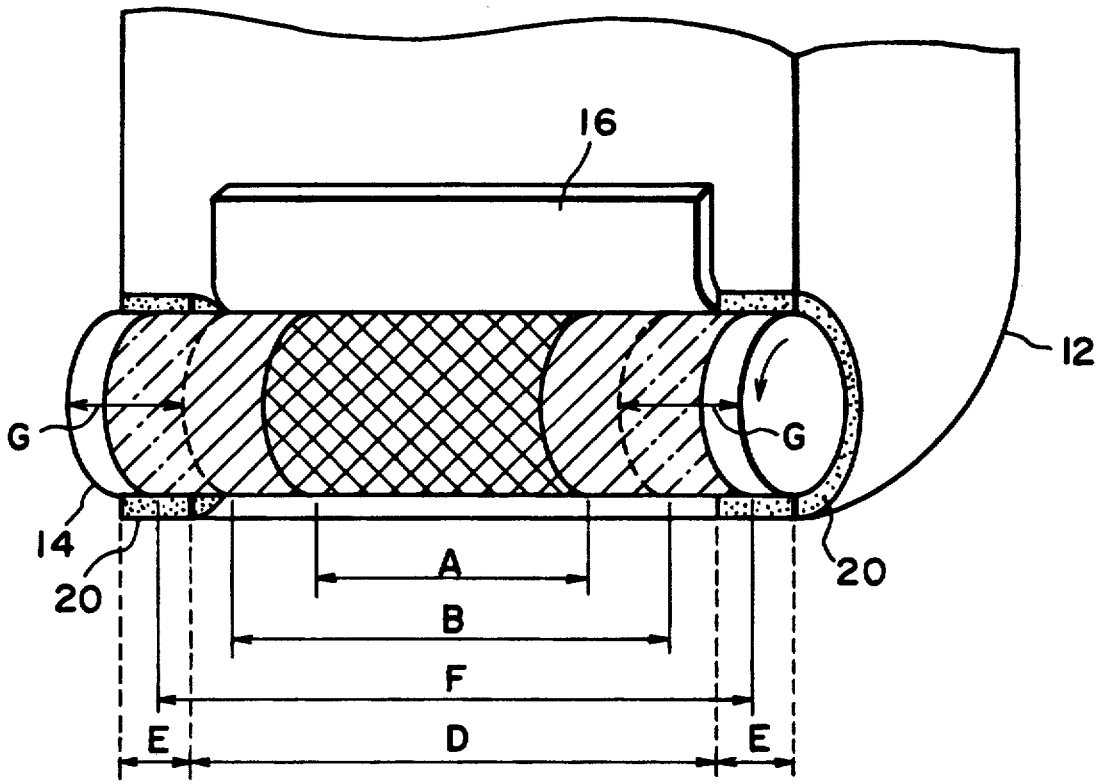
FIG. 3 is a perspective view of a developing apparatus according to an embodiment of the present invention.
Figure 4:
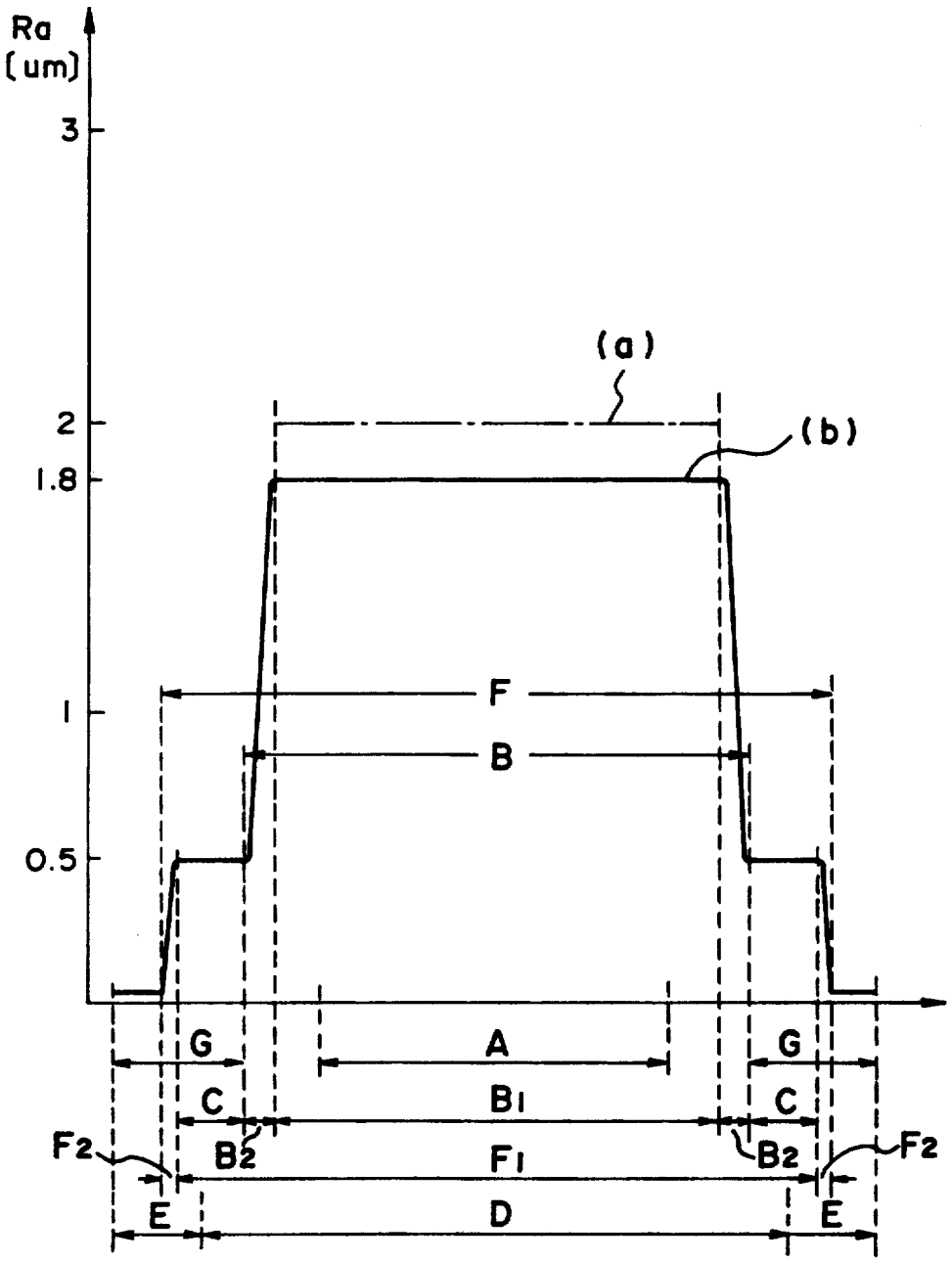
FIG. 4 illustrates the dimensional relations of various regions in the apparatus of the present invention.

The region of the base roughened by sand-blasting and the region coated with conductive resin are as shown in FIGS. 3 and 4. More particularly, all the length of the base 17 of the sleeve 14 is not roughened rather, the surface is roughened only in the region B excepting the regions G adjacent the opposite longitudinal ends. The length relations among the regions will be described (length in this Specification means the longitudinal dimension of the sleeve, and therefore, of the base member).

Referring to FIGS. 3 and 4, the length of the blast-treated region B is larger than the length of the image forming region of the photosensitive member. The length of the region F which is coated with the resin coating layer 18 is larger than the length of the region B and is smaller than the entire length of the base member 17. The blast-treated region B includes a completely blasted region B1 which has been blast-treated for the predetermined surface roughness (preferably, the center line average surface roughness Ra is not less, than 1.0 micron and not more than 3.5 microns) and a partially blasted region B2 of a small width which is between the non-blasted region and the blasted region and which is not completely blasted. The resin layer region F includes a completely coated region F1 which has been substantially uniformly coated with the resin layer in a predetermined thickness (preferably not less than 5 microns and not more than 15 microns) and a partially coated region F2 of a small width which is between the coated region and the non-coated region and which is not stably coated. The widths of the partially blasted region B2 and the partially coated region F2 are less than 1 mm, although they are exaggerated in the Figure. Accordingly, in this Specification, if there is no particular statement, the surface roughness of the blast-treated region of the base means that of the completely blasted region; the surface roughness of the resin layer in the blast-treated region of the base member means that of the resin layer in the completely blasted region of the base member; and the surface roughness of the resin layer in the non-blasted region of the base member is that of the completely coated region of the resin layer in the non-blasted region of the base member. The length of the region D for carrying the developer, that is, the width of the outlet of the developer of the container 12 in which the blade 16 is contacted to the sleeve 14, is not less than the length of the region B and is smaller than the length of the region F. The sealing members 20 are contacted to the regions E which are outside of the region D.

The sealing members 20 function to prevent leakage of the developer from the container 12 to the outside through the longitudinally opposite end portions of the sleeve 14. Each is fixed on a side plate of the container 12 and is contacted to the peripheral surface of the sleeve adjacent the respective longitudinal ends at the container side along the rotational direction of the sleeve 14. The material of the sealing member may be soft materials such as felt or moltplane or the like.

FIG. 4 is a graph of surface roughness (Ra) vs. longitudinal position of the sleeve. The roughness of the blast-treated surface of the base member (the surface roughness of the completely blasted region B1) is approximately 2 microns. The surface roughness (b) of the coating in the region B1 was approximately 1.8 microns. Therefore, in this region, the conveying force for the developer is strong, and the triboelectric charge amount of the developer is properly controlled.

In the region G, the surface roughness is smaller than the region B. In the region C within the region G, that is, the completely coated region C adjacent an end of the resin layer coated region F (the region in which the resin layer is formed on the smooth surface of the base member), the surface roughness Ra is approximately 0.5 microns. Therefore, the developer conveying power in this region is weak.

Figure 5:
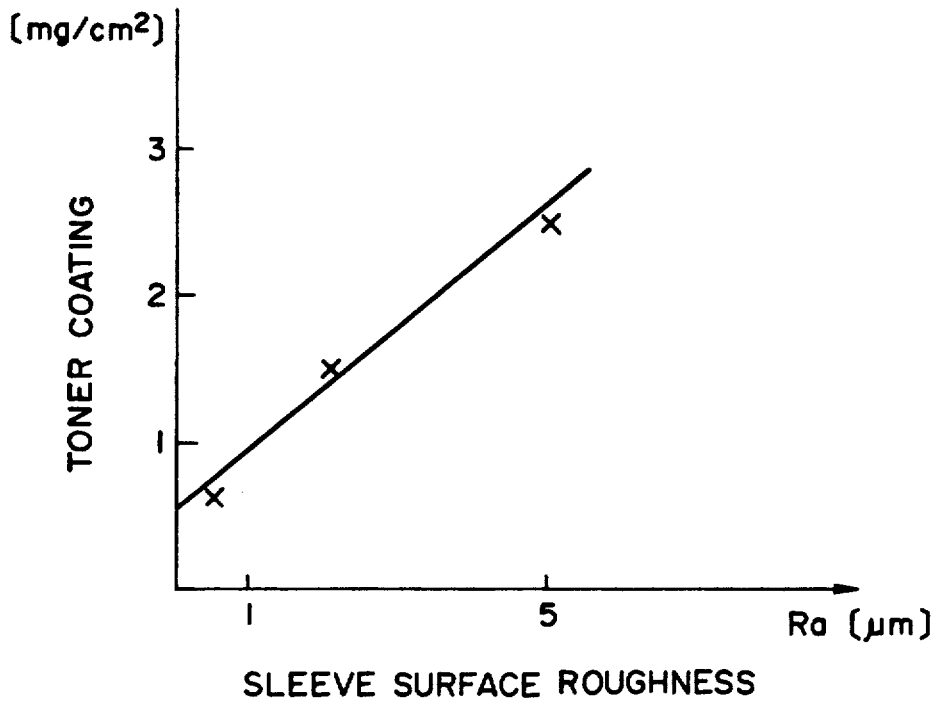
FIG. 5 shows a relation between the sleeve surface roughness and the quantity of the coated toner particles.

FIG. 5 is a graph of the toner coating quantity on the sleeve vs. the surface roughness of the sleeve Ra. In the apparatus of this embodiment, when the surface roughness Ra in the region B is approximately 1.8 microns, the quantity of the toner coating on the sleeve is approximately 1.3 mg/cm$^2$; and in the region C, when the surface roughness Ra is approximately 0.5 micron, it is approximately 0.7 mg/cm$^2$. It will be understood that the toner carrying and/or conveying power is small in the regions C adjacent the longitudinal ends of the sleeve.

In the shown embodiment, the sealing member 20 is press-contacted to both of region C and the base-flatregion on which the coating is not formed. Since the sealing member 20 is contacted to the region having the smaller conveying force for the developer, the developer leakage preventing effect is improved. The surface roughness Ra of the region layer in the region C is so small that the sliding property and the lubricating property with the sealing member contacted thereto are improved, thus preventing or suppressing wear or damage of the sealing members 21.

It is not preferable that the region E is disposed completely outside the region F, by which the smooth metal surface of the base member 12 is exposed as the sleeve surface between the region E and the region F. This is because, although the mechanical conveying force for the developer of the exposed smooth surface is weak, the triboelectric charging power for the developer is high, and therefore, the resultant effect is the tendency to form a non-uniform developer layer. If this occurs, the developer will be scattered; the photosensitive member will be contaminated; and the image may be deteriorated. On the other hand, it is permissible that the region E is provided only in the region F. However, it is preferable that a part of the sealing member 20 is directly contacted to a part of the marginal smooth metal surface of the base member 17, as shown in the Figure. This is because when the coating layer 18 is peeled off in the region E by friction with the sealing member 20, the sealing performance is deteriorated.

The surface roughness Ra in this Specification means the center line average surface roughness defined in JIS (Japanese Industrial Standard) B-0601.

EMBODIMENT 2

In this embodiment, fine graphite particles are added as a conductive solid lubricant to the ingredients of the resin layer 18 in the first embodiment described hereinbefore.

| <Coating 2> | |
|---|---|
| Resin (binder): | 30 wt. parts |
| Phenol resin (solid) | |
| Carbon black fine particles: | 15 wt. parts |
| CONDUCTEX 975UB (available from Columbian Carbon) | |
| Conductive lubricant: | 15 wt. parts |
| Artificial graphite fine particles (7 microns in the average particle size) | |
| Diluent: | 225 wt. parts |
| Isopropylalcohol, butanol | |

In this embodiment, too, similarly to the first embodiment, the sleeve base has been sand-blasted in a region larger than the image region A and smaller than the developer outlet width D or smaller than the interval between the end sealing regions E. Thereafter, the resin layer was applied in a region larger than the blasted region. By doing so, the image region A is contained in the blasted region B, and therefore, the surface roughness of the sleeve in the region A is suitable for image formation (Ra is approximately 1.8), and the surface roughness of the resin layer in the regions E adjacent the longitudinal ends is small enough (Ra is approximately 0.5 micron) to suppress the toner conveying force. Accordingly, in the second embodiment, the image density is improved with the suppression of fog, and in addition, leakage of the developer through the sleeve ends can be prevented.

The fine graphite particles, similarly to fine carbon particles (carbon black), constitute a leakage site for excessive toner charge, and in addition, the solid lubricancy is high, and therefore, they are effective for mechanically reducing the fine toner particle deposition on the sleeve, thus enhancing the ghost preventing effects, and in addition, they are effective for enhancing the developer leakage preventing effects through the opposite ends of the sleeve. Furthermore, they are effective for preventing damage to sealing member.

EMBODIMENT 3

In this embodiment, only the fine graphite particles were dispersed in the binder resin for the resin layer 17.

| <Coating 3> | |
|---|---|
| Resin (binder): | 15 wt. parts |
| Phenol resin (solid) | |
| Conductive lubricant: | 15 wt. parts |
| Artificial fine graphite particles (1 micron in the average particles size) | |
| Diluent: | 225 wt. parts |
| Isopropylalcohol, butanol | |

Similarly to the foregoing embodiments, the base member 17 was blast-treated and was coated by spray with the above paint. It has been confirmed that a high density can be produced with suppressed background fog, and that the developer is effectively prevented from leaking out.

In the foregoing embodiments, the opposite longitudinal end surfaces of the elastic blade 16 are contacted to the inside surface of the sealing member 20. This is advantageous from the standpoint of assured prevention of the leakage of the toner in the direction of the rotation of the sleeve from the opposite ends of the blade. However, it is required that the manufacturing accuracies of the blade 16 and the sealing member 20 and the assembling accuracy of the developing apparatus are enhanced This is because, if the end surface of the blade 16 is strongly pressed to the sealing member 20, the pressure between the blade 16 and the sleeve 14 becomes non-uniform, with the result of a non-uniform thickness of the toner layer.

In the following embodiment, a small clearance is provided between each of the ends of the elastic blade and the associated end surface of the sealing member, from the above-described standpoint.

Figure 6:
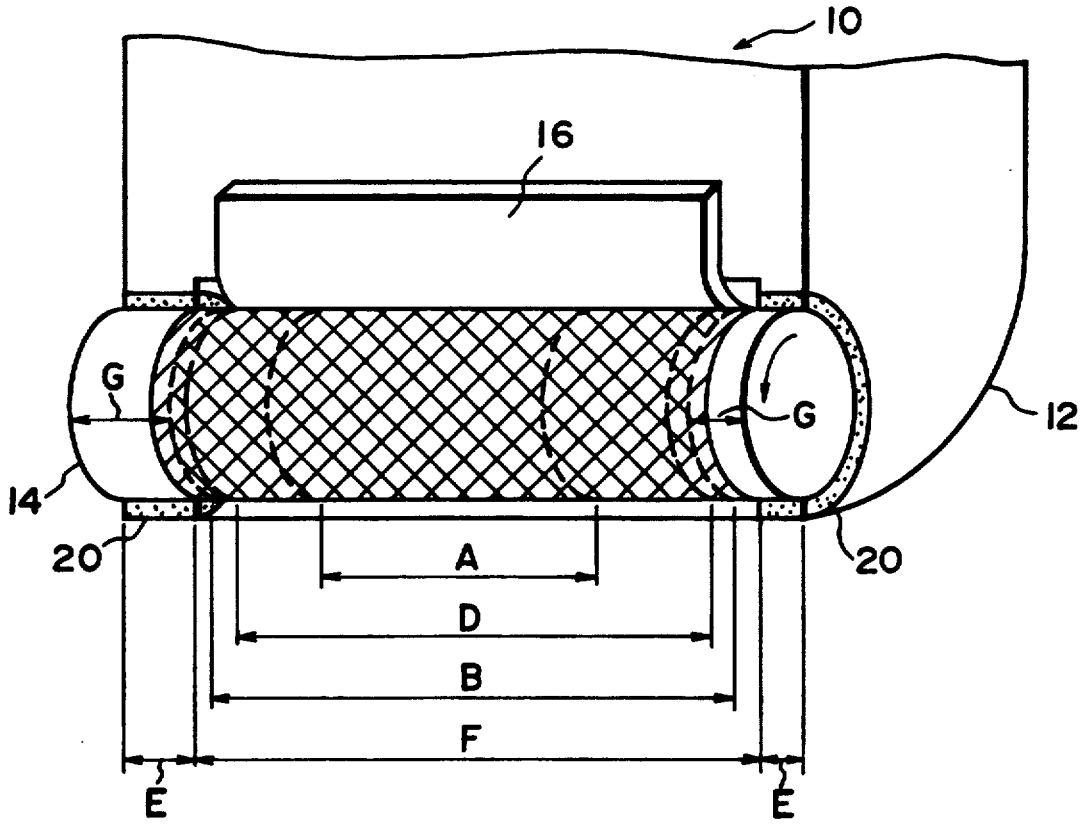
FIG. 6 is a perspective view of a developing apparatus according to a further embodiment of the present invention.

For example, a sleeve 14 shown in FIG. 6 is manufactured in the following manner. A drawn aluminum tube (sleeve base) 17 having a mirror surface was air-sand-blasted in a usual manner with alundum abrasive particles (irregular particles).

The coating 1 described hereinbefore is applied by air spray method. It was dried, and a coating 18 having a thickness of approximately 7 microns was formed. The center line average surface roughness Ra of the region B1 was 2.0 microns.

Figure 7:
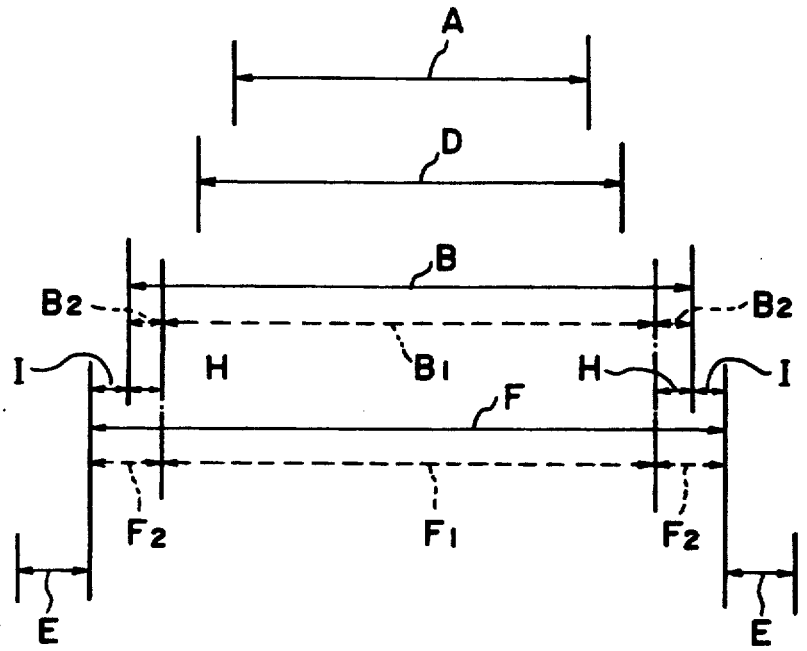
FIG. 7 illustrates the dimensional relations of the various regions in the apparatus according to a further embodiment of the present invention.

The region in which the base member is roughened by sand-blasting and the region which is coated with the conductive resin, are as shown in FIGS. 6 and 7.

In FIGS. 6 and 7, the length of the blasted region B is larger than the length of the image forming region A. The region F having the coated layer is larger than the length of the blast-treated region B. The length of the region D for regulating the developer layer thickness, that is, the length of the region D in which the blade 16 is contacted to the sleeve, is not less than the length of the region A and is smaller than the length of the blast-treated region B. The sealing member 20 is contacted to the regions E which are outside of the region F.

If the end surface of the blade 16 is strongly press-contacted to the end surface of the sealing member 20, the pressure between the blade 16 and the sleeve becomes non-uniform, and therefore, uniform thickness of the developer layer can not be provided. Therefore, a small clearance is provided between the blade contact region D and the seal contact region E at the opposite longitudinal sides of the region D. The clearance is 0.5–1 mm, for example.

In FIG. 7, the length of the completely blasted region B1 and the length of the completely coated region F1 are indicated as being the same. However, this is not limiting, and one may be larger than the other. However, the length of the completely painted region is larger than the blade contact region D, as shown in FIG. 7, since then a uniformly charged and uniform thickness developer layer can be formed over the entire width of the region D. The center line average roughness Ra of the region which has been completely blasted and completely coated, is preferably 1.0–3.5 microns. If the roughness Ra is smaller than 1.0 micron, the thickness of the developer layer is too thin. In addition, there occurs a tendency that the developer is excessively charged by triboelectricity with the possible result of a decrease in the image density of the developed image. If the roughness Ra is larger than 3.5 microns, the thickness of developer layer is too thick, and the charge distribution of the developer is non-uniform with the resulting tendency of a decrease of the image density and a non-uniformity in the image.

The sleeve surface roughness R1 in the completely blasted and completely coated region, and the surface roughness R2 in the partially blasted region H, and the surface, roughness R3 in the region G which is partially painted without blasting, satisfy:

$$R1 > R2 > R3 \quad (1)$$

As regards the surface roughness of the sleeve base before the region coating, the surface roughness R1′ in the completely blasted region, the surface roughness R2′ in the partially blasted region H, and the surface roughness R3′ in the non-blasted region I, satisfy:

$$R1' > R2' > R3' \quad (2)$$

Since the surface roughness of the coating resin layer is dependent on the surface roughness of the sleeve base, and therefore, the inequalities (1) are satisfied.

When the surface roughnesses of the sleeve are as defined in the inequalities (1), the quantities of the toner M1, M2 and M3 on the sleeve in the regions having the surface roughnesses R1, R2 and R3, satisfy:

$$M1 > M2 > M3 \quad (3)$$

Since the quantity of the toner conveyed is dependent on the surface roughness of the sleeve, the quantity of the toner is small in the regions H and I, particularly in the region I, and therefore, the inequalities (3) are satisfied.

As described in the foregoing, the surface roughnesses of the regions H and I contained in the region between the blade end and the seal end are made smaller than the completely blasted and completely painted region, and therefore, the toner conveying amount in the regions H and I can be reduced. Accordingly, even if the number of prints increases, the developer is prevented from scattering from the ends of the developing device, the non-uniformity resulting from contamination of the seal is prevented, and the prevention of non-uniformity of the toner coating at the opposite ends of the sleeve can be achieved.

The following is an example of ingredients of the magnetic toner used:

| | |
|---|---|
| Styrene/butylacrylate/divinylbenzene copolymer (copolymerization ratio: 80/19.5/0.5, weight-average molecular weight: 320,000) | 100 wt. parts |
| Triiron tetraoxide (average particle size: 0.2 micron) | 80 wt. parts |
| Cr complex of azo dye | 1 wt. parts |
| Low molecular weight propyrene-ethylene copolymer | 4 wt. parts |

They were mixed, kneaded, coarsely pulverized, finely pulverized and classified so that toner particles having the following particle size distribution were produced:

(i) Not more than 5 microns: 35.4% by number
(ii) 6.35–10.08 microns: 36.9% by number
(iii) Not less than 16 microns: 0.5% by volume
(iv) Volume average particle size: 0.6 microns
(v) N/V=3.5

Fine silica particles of 12 parts by weight treated with dimethylsilicone oil were added to 100 parts by weight of the above classified toner. Thus, a negatively chargeable magnetic toner of insulating property was produced.

The sleeve used had a center line average surface roughness as follows:

R1=2.0 microns
R2=1.0, micron
R3=0.8 micron

At the initial stage of the operation, the quantities of the toner on the sleeve were as follows:

M1=1.8 mg/cm$^2$
M2=1.0 mg/cm$^2$
M3=0.5 mg/cm$^2$

These results satisfy the inequalities (3).

Using this developing device, printing operations were continued. It has been confirmed that toner did not scatter from the longitudinal ends of the developing device even after 5000 sheets were printed; that non-uniformity due to contamination of the seal was not observed; and that the toner coating was uniform even adjacent the opposite ends of the sleeve.

The center line average roughness Ra at the marginal portions of the resin coating region, that is, the region in which the resin is applied but the base is not roughened, is smaller than the surface roughness Ra in the region in which the base member is blast-treated and then resin is applied. More particularly, however, it is preferably not more than 0.8 micron.

The resin layers 18 were produced using the coating 2 and the coating 3 described hereinbefore in the example of FIGS. 6 and 7. It has been confirmed that the same advantageous effects can be provided.

Figure 8:
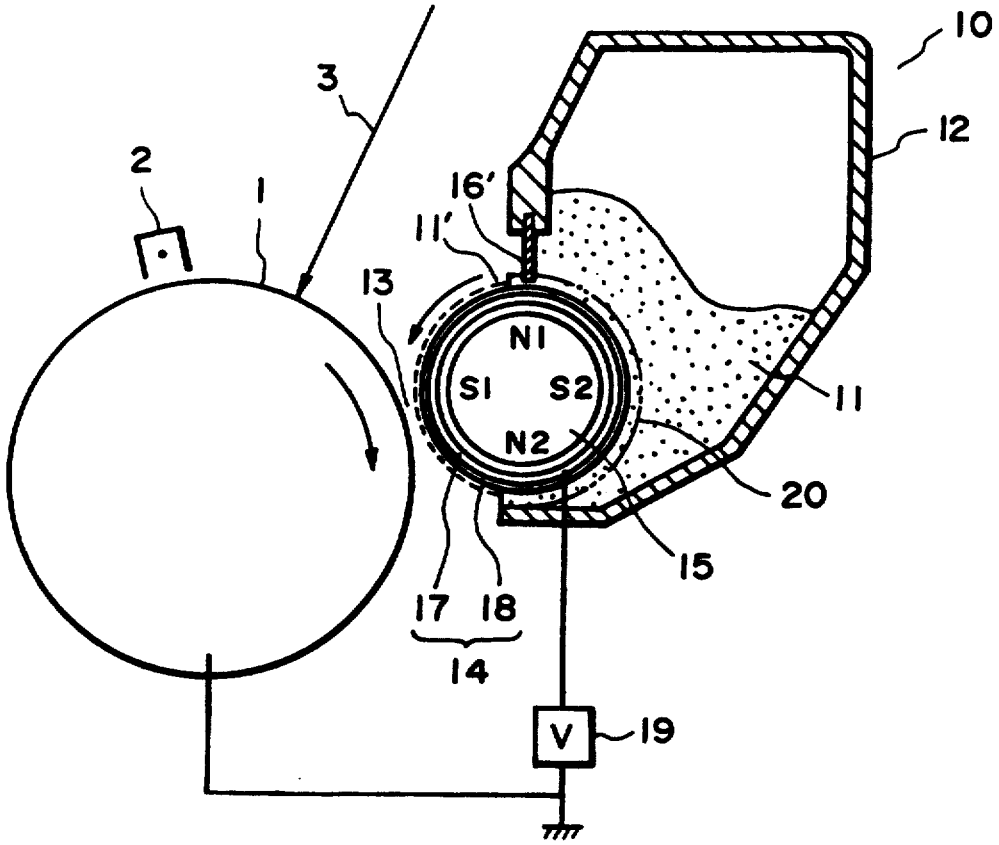
FIG. 8 is a sectional view of a developing apparatus according to a further embodiment of the present invention.

FIG. 8 shows an additional example in which the developer layer thickness regulating member is modified from those shown in FIGS. 2 and 6. The same reference numerals as in FIGS. 2 and 6 are assigned to the elements having the corresponding functions, by which the detailed descriptions thereof are omitted.

In FIG. 8, a ferromagnetic metal blade 16' is faced to a magnetic pole N1 of the magnet 15 fixed in the sleeve 14 and is faced to the sleeve 14 with a small clearance. As disclosed in U.S. Pat. No. 4,387,664, the magnetic field from the magnetic pole N1 is concentrated on the magnetic blade 16' so that a magnetic curtain is established between the sleeve surface and the tip end of the blade 16'. The magnetic curtain functions to regulate the thickness of the one component magnetic developer, so that a layer of the developer having a thickness smaller than the clearance between the sleeve and the drum in the developing zone is formed.

In this embodiment, the blade 16' is rigid, and is not press-contacted to the sleeve. Therefore, as shown in FIG. 6, the width of the blade 16', that is, the developer regulating width D of the blade 16', is equal to the interval between the seals 20 (regions E), and the surfaces of the seals 20 are contacted to the end surfaces of the blade 16'. The developer layer thickness regulating width D is larger than the width of the blast-treated region B and is within the resin coating region F.

In the regions I and H adjacent the sleeve ends in this embodiment, the magnetic sealing effect (due to the cooperation between the magnetic blade and the sleeve), is more effective to limit the amount of toner particles applied on the sleeve than in the completely blasted and completely coated region, even if the number of prints is increased. However, the triboelectric charge application to the toner particles when the magnetic blade is used is lower than the case in which the elastic blade 16 is used. This is because the pressure of the toner particles onto the sleeve by the magnetic blade is smaller than when the elastic blade is used. Therefore, excessive toner charging adjacent the sleeve end does not occur even if the width of the magnetic blade is made larger than the width of the completely blasted and completely coated region of the sleeve. Therefore, even if the number of prints increases, toner scattering from the sleeve ends, non-uniformity due to the seal contamination and non-uniformity of the toner coating on the sleeve, can be prevented.

Figure 9:
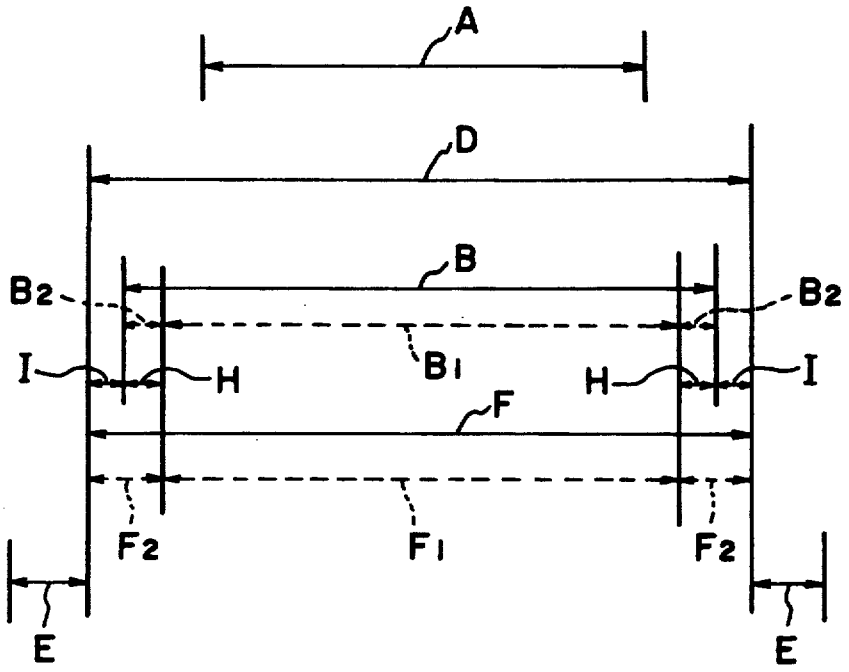
FIG. 9 illustrates the dimensional relations of various regions in the apparatus according to a further embodiment of the present invention.

In FIGS. 7 and 9, the sealing members 20 are contacted to the smooth surface of the base member having a surface roughness which is smaller than the resin coating layer on the non-roughened surface thereof. The inside ends of the sealing members 20, and therefore, the inside ends of the regions E are substantially faced to the outside ends of the resin coating region F. By doing so, damage to the sealing member can be further prevented, the packing of the toner into the clearance between the sealing member and the sleeve can be further prevented, and damage to the resin coating layer by the sealing member can be further prevented.

In FIGS. 7 and 9, the inside ends of the region E where the sealing members 20 are contacted to the sleeve 14 also may be disposed in the region I. In this case, parts of the sealing members 20 are contacted to end portions of the resin coating layer F. However, in these regions, the surface roughness of the resin layer is small, and therefore, damage to the sealing member or the resin layer can be reduced.

A part-circular ring of magnetic material such as iron may be faced to the sleeve with a small clearance in the region in which the sealing member is contacted in the above embodiment, so that a magnetic field is established between the magnet 15 and the magnetic member, by which leakage of the developer is prevented. Further alternatively, a part-circular ring magnet, as disclosed in Laid-Open Utility Model Application No. 41889/1980, may be faced to the sleeve in the region in which the sealing member is contacted to prevent leakage of the developer by the magnetic field provided by the magnet. However, these alternatives are inapplicable to a case in which a non-magnetic developer is used. In this Specification, the sealing member is stated as "faced to the sleeve" when the sealing member is contacted to the sleeve and when there is a small clearance therebetween.

The ratio between the fine carbon black particles and fine graphite particles dispersed in the conductive resin layer 18 is not limited to the value defined with the coating 2. Experiments have been conducted for carbon/graphite=1/9-9/1. It has been confirmed that similar good results as in the foregoing embodiments can be provided.

The average particle size of the graphite dispersed in the conductive resin layer was changed, and it has been confirmed that 0.3-7 microns were effective irrespective of whether they are natural or artificial ones.

In addition, the ratio P/B between the fine conductive particles and the binder resin was changed, and it has been confirmed that good results are provided within the range of ½-2/1 of P/B.

The surface roughness Ra of the region B after the conductive resin layer is formed is preferably 1-3.5 microns. On the other hand, the surface roughness of the conductive resin coating formed in the smooth surface region of the untreated base member is preferably not more than 0.8 micron. The surface roughness Ra in the region is larger than the surface roughness of the smooth surface region of the base member not roughened.

In order to effectively prevent over charging of the developer described hereinbefore, the volume resistivity of the coating layer is preferably $10^2$-$10^{-6}$ ohm.cm, and the thickness preferably is 5-16 microns.

In the foregoing embodiments, the base member is roughened by sandblasting with irregular abrasive particles. However, regular particles (where each particle is generally round without sharp edge and has a constant shape). Another alternative is the use of sand paper.

The following is an example of a particle size distribution of a one component magnetic developer:

(i) Not more than 5 microns: 17-60% by number
(ii) 6.35-10.08 microns: 5-50% by number
(iii) Not less than 12.7 microns: not more than 2% by volume
(iv) Volume average particle size 6-9 microns
(v) The magnetic toner particles having particle sizes not more than 5 microns, satisfy:

$$N/V = -0.05\,N \times k$$

where

N: percentage by number of toner particles having a size of not more than 5 microns,
V: percentage by volume of toner particles having a size of not more than 5 microns,
k: a positive value between 4.6 and 6.7, inclusive.
N: a positive value between 17 and 60, inclusive.

However, the present invention is applicable to a developing apparatus operable with a one component non-magnetic developer.

Figure 10:
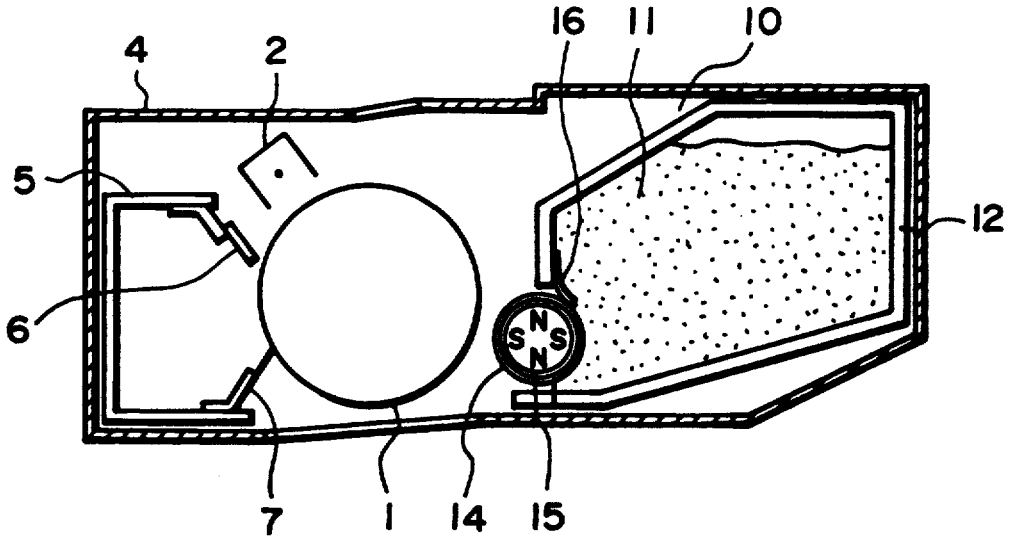
FIG. 10 is a sectional view of a process cartridge using the developing apparatus according to an embodiment of the present invention.

FIG. 10 shows a process cartridge containing a developing apparatus 10 according to an embodiment of the present invention. The process cartridge is in the form of a unit comprising a photosensitive member 1 and a developing device 10 or further a cleaning device 5 in a common frame 4. The process unit is detachably mountable to an image forming apparatus. When the developer in the developing device 10 is used up, a new process cartridge replaces the old cartridge. Therefore, a maintenance or servicing operation can be eliminated, since the photosensitive member and the developing device and possibly the cleaning device in the new cartridge are new ones. When the present invention is used in a process cartridge, the advantageous effects (prevention of toner scattering from the end portions of the developing device, prevention of non-uniformity due to contamination, and prevention of non-uniform toner coating adjacent the sleeve end portions) can be more effectively utilized In FIG. 10, the process cartridge comprises the photosensitive drum 1, the developing device 10, the primary charger 2, the cleaner container 5, the cleaning blade 6 and the toner leakage preventing sheet to prevent leakage from the cleaner. They are mounted as a unit on the frame 4, and the cartridge is detachably mountable to the image forming apparatus as a unit.

While the invention has been described with reference to the structures disclosed herein, it is not confined to the details set forth and this application is intended to cover such modifications or changes as may come within the purposes of the improvements or the scope of the following claims.

What is claimed is:

1. A developing apparatus, comprising:

a container for containing a one component developer;

a rotatable developing roller disposed faced to an image bearing member to carry the developer from said container to a developing zone where the developer is supplied to an electrostatic latent image carried on the image bearing member, said developing roller comprising a metal base member and a resin coating layer thereon in which fine conductive particles are dispersed, and wherein said developing roller has a surface including an end region adjacent an end of the roller and an intermediate region, wherein, in the end region, the base member is not roughened and the resin layer is not provided, and in the intermediate region, the base member is roughened and is coated with the resin layer; and a sealing member for preventing leakage of the developer from said container at an end of said developing roller, said sealing member being faced to the end region of said developing roller.

2. A developing apparatus according to claim 1, wherein the fine conductive particles are carbon black.

3. A developing apparatus according to claim 1, wherein the fine conductive particles are graphite.

4. A developing apparatus according to claim 1, wherein the fine conductive particles are carbon black and graphite.

5. A developing apparatus according to any one of claims 1–4, wherein the resin coating layer has an average surface roughness Ra of 1–3.5 microns in the region in which the base member is roughened, and has an average surface roughness Ra of not more than 0.8 micron in a region in which the base member is not roughened.

6. A developing apparatus according to claim 5, further comprising a voltage source for applying an oscillating bias voltage to said developing roller.

7. An apparatus according to claim 6, further comprising a regulating member for regulating a thickness of a layer of the developer carried on said developing roller to the developing zone so that it is smaller than a minimum clearance between said developing roller and the image bearing member.

8. A developing apparatus, comprising:

a container for containing a one component developer;

a rotatable developing roller disposed faced to an image bearing member to carry the developer from said container to a developing zone where the developer is supplied to an electrostatic latent image carried on the image bearing member;

where said developing roller comprises a metal base member and a resin layer thereon in which fine conductive particles are dispersed, and wherein said developing roller has on its surface a first region which is adjacent an end and in which the base member is not roughened and in which the resin layer is not provided, a second region, inside the first region, in which the base member is not roughened and which is coated with the resin layer, and a third region, inside the second region, in which the base member is roughened and which is coated with the resin layer;

a regulating member for regulating a thickness of a layer of the developer to be carried on the developing roller to the developing zone, said regulating member effecting its regulating operation in a regulating region which is shorter than a length of the resin layer; and a sealing member for preventing leakage of the developer from said container through an end of said developing roller, wherein said sealing member is faced to the first and second regions of said developing roller.

9. A developing apparatus according to claim 8, wherein the conductive fine particles are carbon black.

10. A developing apparatus according to claim 8, wherein said fine conductive particles are graphite.

11. A developing apparatus according to claim 8, wherein said fine conductive particles are carbon black and graphite.

12. A developing apparatus according to any one of claims 8–11, wherein an average surface roughness of the third region is larger than an average surface roughness of the second region, and an average surface roughness of the first region is smaller than the average surface roughness of the second region.

13. A developing apparatus according to claim 12, wherein said sealing member is in contact with a peripheral surface of said developing roller in the first and second regions.

14. A developing apparatus according to claim 13, further comprising a voltage source for applying an oscillating bias voltage to said developing roller.

15. A developing apparatus according to claim 14, wherein said regulating member regulates the developer so that a thickness of a layer of the developer is smaller than a minimum clearance between said developing roller and said image bearing member in the developing zone.

16. A developing apparatus, comprising:

a container for containing a one component developer;

a rotatable developing roller disposed faced to an image bearing member to carry the developer from said container to a developing zone where the developer is supplied to an electrostatic latent image carried on the image bearing member;

where said developing roller comprises a metal base member and a resin layer thereon in which fine conductive particles are dispersed, and wherein said developing roller has on its surface a first region which is adjacent an end and in which the base member is not roughened and in which the resin layer is not provided, a second region, inside the first region, in which the base member is not roughened and which is coated with the resin layer, and a third region, inside the second region, in which the base member is roughened and which is coated with the resin layer; and a regulating member for regulating a thickness of a layer of the developer to be carried on the developing roller to the developing zone, said regulating member effecting its regulating operation in a regulating region which is not longer than a length of the resin layer;

a sealing member for preventing leakage of the developer from said container at an end of said developing roller, said sealing member being disposed the first region of said developing roller, and an inside end thereof is substantially faced to a boundary between the first region and the second region.

17. A developing apparatus according to claim 16, wherein the fine conductive particles are carbon black.

18. A developing apparatus according to claim 16, wherein said fine conductive particles are graphite.

19. A developing apparatus according to claim 16, wherein said fine conductive particles are carbon black and graphite.

20. A developing apparatus according to any one of claims 16–19, wherein an average surface roughness of the third region is larger than an average surface roughness of the second region, and an average surface roughness of the first region is smaller than the average surface roughness of the second region.

21. A developing apparatus according to claim 20, wherein said sealing member is in contact with a peripheral surface of the developing roller in the first region.

22. A developing apparatus according to claim 21, further comprising a voltage source for applying an oscillating bias voltage to said developing roller.

23. A developing apparatus according to claim 22, wherein said regulating member regulates the developer so that a thickness of a layer of the developer is smaller than a minimum clearance between said developing roller and said image bearing member in the developing zone.

* * * * *

UNITED STATES PATENT AND TRADEMARK OFFICE

CERTIFICATE OF CORRECTION

PATENT NO. : 5,202,729

DATED : April 13, 1993

INVENTOR(S) : TOSHIO MIYAMOTO, ET AL.

It is certified that error appears in the above-indentified patent and that said Letters Patent is hereby corrected as shown below:

COLUMN 4

Line 32, "force" should read --a force--.

COLUMN 5

Line 67, "less," should read --less--.

COLUMN 7

Line 9, "members 21." should read --members 20.--.
Line 28, "The surface" should read --Surface--.

COLUMN 8

Line 3, "the" should be deleted.
Line 8, "to" should read --to the--.
Line 26, "paint" should read --coating--.
Line 27, "can" should read --image can--.
Line 39, "enhanced" should read --enhanced.--.

COLUMN 9

Line 16, "painted" should read --coated--.
Line 31, "of" (second occurrence) should read --in--.
Line 37, "painted" should read --coated--.
Line 67, "painted" should read --coated--.

UNITED STATES PATENT AND TRADEMARK OFFICE

CERTIFICATE OF CORRECTION

PATENT NO. : 5,202,729

DATED : April 13, 1993

INVENTOR(S) : TOSHIO MIYAMOTO, ET AL.

It is certified that error appears in the above-indentified patent and that said Letters Patent is hereby corrected as shown below:

COLUMN 12

Line 47, "shape)." should read --shape) alternatively could be used.--

COLUMN 13

Line 38, "one component" should read --one-component--.
Line 62, "the" should read --said--.
Line 64, "the" should read --said--.

COLUMN 14

Line 15, "one component" should read --one-component--.
Line 46, "conductive fine" should read --fine conductive--.

UNITED STATES PATENT AND TRADEMARK OFFICE

CERTIFICATE OF CORRECTION

PATENT NO. : 5,202,729

DATED : April 13, 1993

INVENTOR(S) : Toshio Miyamoto, et al

It is certified that error appears in the above-indentified patent and that said Letters Patent is hereby corrected as shown below:

COLUMN 15

Line 4, "one component" should read --one-component--.
Line 22, "and" should be deleted.
Line 28, "layer;" should read --layer; and--.

Signed and Sealed this

Twelfth Day of April, 1994

Bruce Lehman

*Attest:*

BRUCE LEHMAN

*Commissioner of Patents and Trademarks*

*Attesting Officer*